United States Patent [19]

Mashimo

[11] Patent Number: 4,920,675

[45] Date of Patent: May 1, 1990

[54] ADVERTISEMENT TOOL

[75] Inventor: Norio Mashimo, Chiba, Japan

[73] Assignee: Sony Corporation, Tokyo, Japan

[21] Appl. No.: 337,046

[22] Filed: Apr. 12, 1989

[30] Foreign Application Priority Data

Apr. 27, 1988 [JP] Japan ..... 63-055862[U]

[51] Int. Cl.[5] ..... G09F 7/00

[52] U.S. Cl. ..... 40/492; 40/1

[58] Field of Search ..... 40/1, 492, 642, 310, 40/124.1, 312; 273/148 R; 206/37

[56] References Cited

U.S. PATENT DOCUMENTS

| | | | |
|---|---|---|---|
| 2,645,977 | 7/1953 | Wilford | 40/492 |
| 2,681,677 | 6/1954 | Poeltl | 40/492 |
| 2,693,648 | 11/1954 | Anderson | 40/492 |
| 3,418,737 | 12/1968 | Lambert | 40/492 |
| 3,950,871 | 4/1976 | Rege | 40/492 |
| 4,027,884 | 6/1977 | Oakley | 273/148 R |
| 4,070,775 | 1/1978 | Brooks | 40/492 |
| 4,165,890 | 8/1979 | Leff | 40/642 |
| 4,197,665 | 4/1980 | Siiter | 40/642 |
| 4,253,259 | 3/1981 | Schaffer et al. | 40/492 |

FOREIGN PATENT DOCUMENTS

| | | | |
|---|---|---|---|
| 102773 | 1/1938 | Australia | 40/492 |

*Primary Examiner*—James R. Brittain
*Assistant Examiner*—J. Hakomaki
*Attorney, Agent, or Firm*—Hill, Van Santen, Steadman & Simpson

[57] ABSTRACT

An advertising tool or sales aid for use in explaining characteristics of a product to a customer, characterized by a case having a top and bottom wall connected by a side wall and being opened at each end and the other side, a plurality of plates which have one end mounted in the case so that the plate can be pivoted from a position in the case to a position extending out of the case. Each of the plates can contain information and/or physical representations, which can be used to stress characteristics of the product being sold.

16 Claims, 2 Drawing Sheets

ADVERTISEMENT TOOL

FIELD OF THE INVENTION

The present invention is directed to an advertising tool or sales aid specifically constructed for explaining advantages of a product to a customer and for the education of salesmen for the product.

BACKGROUND OF THE INVENTION

In a technical field of consumer electronics, such as television receivers, it is difficult to make customers understand certain advantages of the techniques used in a receiver as the techniques become more complicated. Thus, the customer may have problems in distinguishing advantages of one product over another similar product. Therefore, for the explanation of advantages of one product, explanation boards or product models have been made to imaginatively explain the advantages of the product over a competitor's product.

A video apparatus is also used for explanation. However, these explanation board, product models and video apparatus are expensive and they require a lot of labor to be produced. In particular they often are not required in such numbers as to pay for their mass-production.

Explanation boards are normally large so that these devices are usually restricted to a space for exhibitions. The explanation boards are used only for a sales facilitating tool in a special place, for example at a seminar for salesmen or at a trade fair, and the explanation boards are seldom used in a retail shop to directly explain features to the customer.

At the retail location or shop, it is impossible to sufficiently inform a customer of the advantage of a product so that a difference from a prior product or some competitor's product cannot be stressed or pointed out. Therefore, it is impossible to facilitate selling products.

Therefore, it would be desirable to have a small tool or aid which can be used by a seller to explain characteristics of the product and which can be easily used to show advantages of the seller's product and to discriminate these advantages from products of a competitor.

SUMMARY OF THE INVENTION

The object of the present invention is to provide an advertisement tool or sales aid which has a small size and with which advantages of a product can be explained to either salesmen and/or customers.

Another feature of the present invention is to provide the advertisement tool or sales aid for a reasonable price so that it can be used to provide explanation of advantages of a product to be sold and will not be restricted because of space requirements and price.

These objects are achieved in an advertisement tool or sales aid which comprises a rectangular shaped case having a top wall, a bottom wall and a side wall connecting the top wall to the bottom wall; a plurality of plates; means for coupling an end of each of the plates to one end of the case for rotation around an axis between a position with the plate received in the case between the top and bottom walls and a second position with the plate pivoted to extend out of the case; each of the plate contains information to aid in selling a product. For example, the plate can have a window which receives a magnifying lens so that the plate can be used for observing small detailed features of the product which is being sold. The plate can also, besides having one or more windows, be hollow and have a slide mounted therein which contains pictures which can be moved into and out of the windows. Preferably, the plate with the slide or a sliding picture member has two windows, with one window having mounted therein a transparent screen or layer portraying a model of a shadow mask and a second window having a transparent layer as a model of an aperture grill so that a comparison can be made between the grill and mask. A third plate of the tool can have one or more mirrors mounted thereon. For example, a cylindrical mirror surface and a spherical mirror surface so that a comparison of the distortion between the two surfaces can be visualized during a sales presentation.

Other advantages and features of the invention will be readily apparent from the following description of the preferred embodiments, the drawings and claims.

DESCRIPTION OF THE PREFERRED EMBODIMENTS

Figure 1:
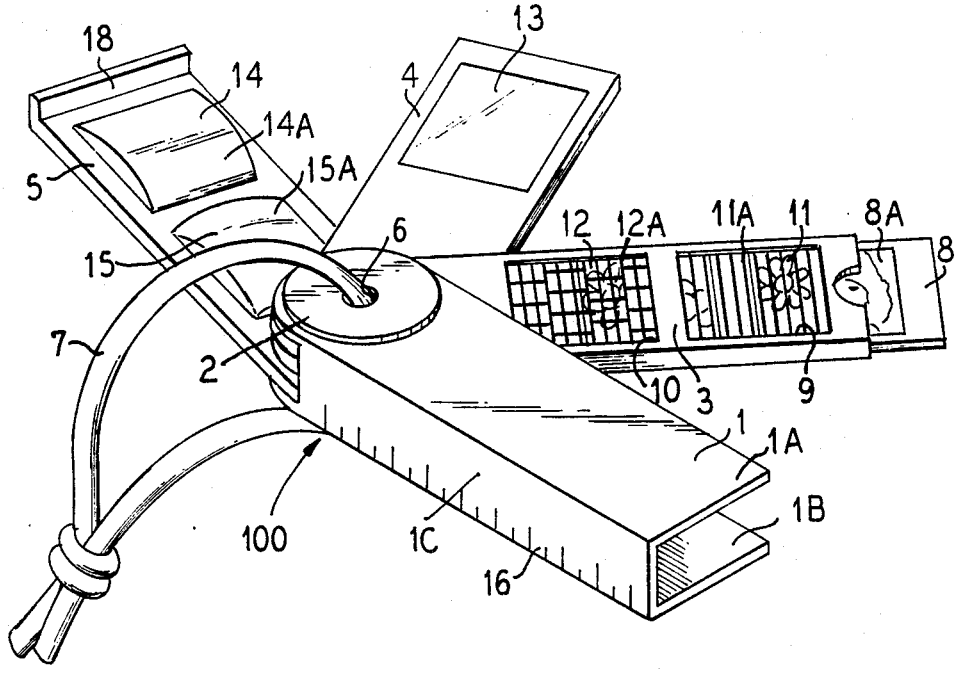
FIG. 1 is a perspective view of the advertisement tool or sales aid in accordance with the present invention.

The principles of the present invention are particularly useful when incorporated into an advertising tool or sales aid, generally indicated at 100 in FIG. 1. The aid or tool 100 has a case 1 which, at one end, is provided with means 2 for pivotably mounting a plurality of plates 3, 4 and 5 in the case 1. As illustrated, the plates have characters, figures, pictures and other material for use in advertising and selling features of a product. The case 1 is small and has a size of 120×35×20 mm. The case 1 acts as both a carrier and a protector for the plates 3, 4 and 5.

Figure 2:
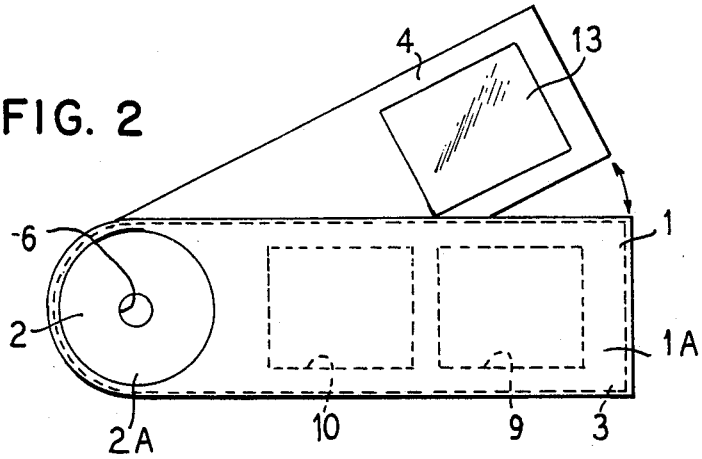
FIG. 2 is a top plan view of the tool or aid of the invention, with one plate being in a partially exposed position.

The case 1 has an upper wall 1A, a lower wall 1B and a side wall 1C that joins the upper and lower walls together. As illustrated, the case is opened on the side opposite the side wall 1C and also at each end. The means 2 mounts the plates 3, 4 and 5 for movement around a single axis, which is illustrated as being a hollow shaft 6 in FIGS. 2 and 3. The shaft 6 extends between enlarged flanges **2*a* and 2*b*. While the means 2** can be formed by a rivet-like member, it can also be formed of threaded together members to make a detachable connection to allow assembly and disassembly if desired.

Figure 4A:
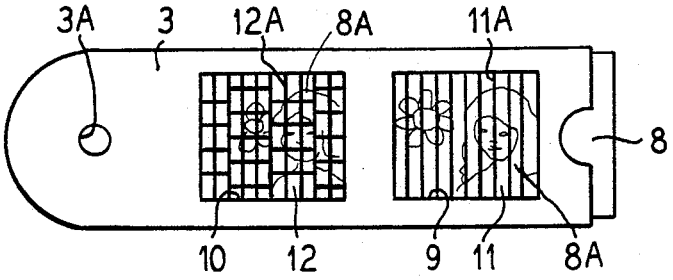
FIG. 4A is a view of a plate having two windows and a picture slide disposed in the plate.
Figure 4B:
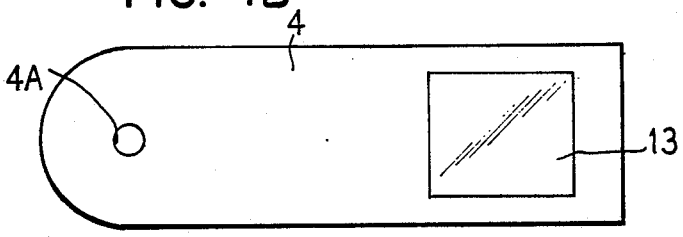
FIG. 4B is a plan view of a plate having a window with a magnifying glass.
Figure 4C:
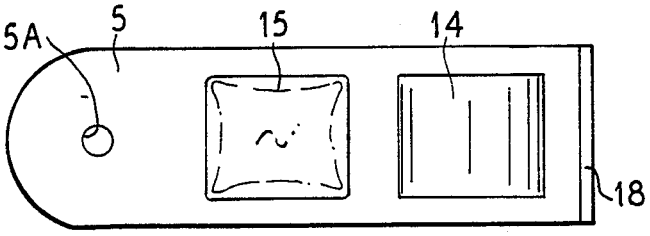
FIG. 4C is a plate having a pair of mirrors mounted on the surface thereof.

To mount the plates, each of the plates 3, 4 and 5, as shown in FIGS. 4A–4C, are provided with holes or openings 3A, 4A and 5A, respectively, which are received on the shaft or tube 6. As illustrated, the plates are mounted so that they can be moved from a first position, which is within the case 1, to a second position extending out of the case to be seen by the customer or to be used in a sales presentation.

In the illustrated embodiment, there are three plates, 3, 4 and 5. The plate 3, as best illustrated in FIGS. 1 and 4A, has a hollow interior which receives a side or a sliding panel 8. The panel 8 is provided with pictures, such as 8A, which can be positioned to be viewed through windows 9 and 10, which are in the outer portion of the plate 3. As illustrated, the window 9 is provided with a transparent sheet 11, which has a model of an aperture grill 11A applied thereon. The window 10 has a transparent sheet 12, which has a model of a shadow mask 12A. These sheets are glued from the inside of the windows, respectively, and the panel 8, which is slidably received in the plate 3, has two identical figures or pictures 8A, which may be photos or illustrations that are positioned side-by-side and can be moved to be presented or viewed through the windows 9 and 10, simultaneously.

As illustrated, the plate 3 can be used for showing the differences of a cathode ray tube manufactured by one company and that of another company. It is prepared so that it can show a comparison of an image viewed through an apertured grill 11A with an image viewed through a shadow mask 12A. Thus, a person looks at the image 8A of the panel in the first plate through the transparent sheets 11 and 12, can compare transparent differences of the windows 9 and 10 that have the different grids or grills. It is easier to accomplish the viewing of the image 8A of the panel or member 8 at the windows by moving the panel 8 within the plate 3 in an inward and outward sliding motion. As mentioned above, a transparency difference of the aperture grill and the shadow mask and of a cathode ray tube will be shown visually and concretely by using the first plate 3. This tool will make the customer understand the products, because it allows a comparison of an image of an aperture grill with that of a shadow mask in a CRT or television tube with regard to transparency.

The second plate 4 has a window that extends therethrough and receives a magnifying lens 13. This lens 13 can be used for showing a structure of a cathode ray tube in a television set which is actually sold to the customers. Because the customer can be shown the structure of the aperture grill magnified by the lens 13, this tool can be used to explain to a customer the superiority of one product over another.

The third plate 5 is a solid member which is provided with two mirrors 14 and 15, as illustrated in FIGS. 1 and 4C. These mirrors 14 and 15 are constructed to provide the screen-shape of a cathode ray tube in a television set and show a comparison of a cylindrical mirror surface 14A of the mirror 14 to a spherical mirror surface 15A of the mirror 15. Thus, the two shapes of the mirror will correspond to the shapes of cathode ray tubes used in different types of television sets, and the customer can compare a degradation of the picture quality from the screen shape by looking at the distortion of the customer's face as it is reflected from the mirrors 14 and 15, respectively. This tool can persuade customers that a picture distortion of a cylindrical-shaped surface 14A for cathode ray tubes is less than that of other shapes.

Figure 4D:
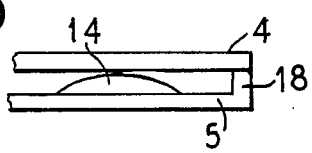
FIG. 4D is a partial side view of the plate of FIG. 4C and an adjacent plate.

In order to protect these mirrors from damage, the free end of the plate 5 is provided with a flange 18, which is best illustrated in FIGS. 1 and 4D. This flange 18 insures a desired spacing between the surface of the plate 5 having the mirrors from the next adjacent plate, such as 4, when the plates are assembled within the case 1, as shown in FIG. 4D. Thus, the flange 18 acts as a spacer.

Since the mounting means 2 has a hollow shaft 6, this hollow shaft can be used to receive a string 7, which extends therethrough to provide a loop for holding the tool. The loop can be a big enough hoop to allow suspending or carrying the tool from a user's neck. Instead of a string 7, a key holder arrangement can have a portion extending through the shaft 6 and, thus, the case can be carried on a key ring.

Figure 3:
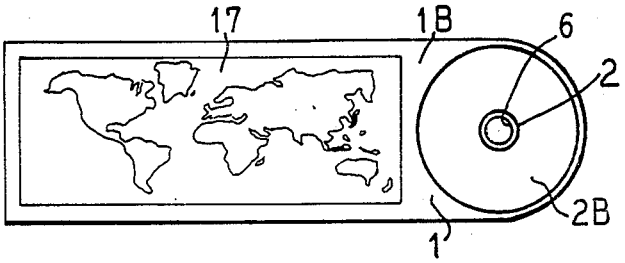
FIG. 3 is a bottom plan view of the tool with all of the plates received within the case.

In addition to the string, the case 1 can be provided with various indicia. For example, a scale of a ruler can be provided on the side wall 1C, as illustrated in FIG. 1. The top and bottom walls can be provided with the company's mark or logo type for the product, which will further advertise the product being sold. It is also possible to put the specifications or other explanations on one of the sides, such as the back face or bottom wall 1B of the case. As illustrated in FIG. 3, a world color television system map 17 has been shown on the lower or bottom wall 1B. In addition to these features, it is also possible to incorporate a tape measure into the case, if desired.

The case 1 can have different sizes and, as illustrated, it contains three plates. If the pivot means 2 is made to be removable, then the plates can be changed when a new product is being introduced. In other words, the plates can be adapted to the particular product, of which the sales aid or advertisement tool is to be used.

The three plates 3, 4 and 5, which are illustrated, can be used to explain, smoothly and simply, a sales point of a product. Each plate is, in turn, used separately or can be used in a combination together. The visual explanation that can be produced by these plates enables the customer to have a better understanding of the product. Adding, storing or moving elements during the explanation, the tool can help provide the customer with an interest in the product. A step-by-step explanation of the superior points of the product using the plates, such as 3, 4 and 5, can help persuade the customer of the desirability of the product. Therefore, this tool makes possible an easy explanation of the superior points and to enable distinguishing the product from other similar products.

Though this tool has been explained as an advertisement tool or aid for selling televisions and for illustrating the differences between different types of televisions, the invention is also able to explain various other products that are not only limited by the present embodiment. In this situation, it is possible that a plurality of plates can used to point out the superior points of any product and that these plates can be stored in a case, such as the case 1.

The invention affords an easy understanding of the superior points for a product or merchandise, provides advertisement and enables education of the consumer by explaining features which are stored on the plurality of plates that are stored in the case and can be used alone or, as desired, in groups to show characteristics, figures, photos and other features.

Because of the small convenient size, the advertising tool is easy to handle, does not require very much space and can be utilized by each and every sales person. In addition, the tool can be manufactured at a reasonable price by a mass-production, because of its simple structure. Thus, it can be easily used to contribute to the sale of a particular product in the retail market.

It should be understood that the above description was presented by way of an example of a preferred embodiment of the invention and it will be apparent that many modifications and variations thereof could be effected by one with ordinary skill in the art without departing from the spirit and scope of the novel concept of the invention so that the scope of the invention should be determined only by the following claims.

I claim:

1. An advertising tool comprising a rectangular-shaped case having a top wall, bottom wall and a side wall connecting the top wall to the bottom wall; a plurality of plates; and means for rotatably coupling one end of each of the plates to one end of the case for movement between a position with the plates received in the case to a position with the plates being pivoted to extend out of the case, one of said plates supporting a picture panel which is slidably mounted for movement in the longitudinal direction of the plate from a free end of said plate, said plate having a window so that pictures on said picture panel can be viewed from outside as the picture panel is moved in said plate.

2. An advertising tool according to claim 1, wherein said one plate has two windows spaced apart, said picture panel having two identical pictures spaced the same distance as said windows, one of said two windows having a model of a shadow mask mounted therein and the other of said two windows having a model of an aperture grill mounted therein.

3. An advertising tool according to claim 1, wherein a measuring scale is provided on one of the walls of said case.

4. An advertising tool according to claim 1, wherein the means for rotatably coupling has a hollow shaft providing a hole in said case, and a string is passed through said case to provide means for carrying the tool.

5. An advertising tool according to claim 1, wherein a second of said plurality of plates has a window receiving a magnifying lens.

6. An advertising tool according to claim 5, wherein a third plate of said plurality of plates has a cylindrical surface-shaped mirror mounted thereon and a spherical surface-shaped mirror mounted adjacent to the cylindrical-shaped mirror.

7. An advertising tool comprising a rectangular-shaped case having a top wall, a bottom wall and a side wall connecting said top and bottom walls; a plurality of plates; and means for rotatably coupling an end of each of said plurality of plates to an end of said case for pivoting on an axis between a position with the plates carried within said case to a position with the plates extending out of said case, one of said plates having a window, and a magnifying lens being mounted in said window.

8. An advertising tool according to claim 7, wherein a measuring scale is drawn on a wall of said case.

9. An advertising tool according to claim 7, wherein the means for mounting has a hollow axle forming a hole in said case, said hole receiving a string passed therethrough for carrying said tool.

10. An advertising tool according to claim 7, wherein another plate of said plurality of plates has a flat surface having a cylindrical surface mirror mounted thereon and a spherical surface mirror mounted adjacent said cylindrical surface mirror.

11. An advertising tool comprising a rectangular-shaped case having a top wall, a bottom wall and a side wall connecting said top and bottom walls; a plurality of plates; and means for coupling ends of said plurality of said plates to an end of said case for rotation between a position with the plates received within the case to a position with the plates extending from said means for mounting out of said case, one of said plurality of plates having two mirrors mounted thereon, one of said two mirrors having a cylindrical surface and the other of two mirrors having a spherical surface.

12. An advertising tool according to claim 11, wherein said one plate has a flange at a free end of a height equal to the height of the mirror surfaces, said flange engaging an adjacent plate when positioned in said case to protect the mirrors attached to said one plate.

13. An advertising tool according to claim 11, wherein a measure scale is drawn on a wall of said case.

14. An advertising tool according to claim 11, wherein said means for mounting includes a hollow axle forming a hole in said case, said hole receiving a string forming a loop for carrying said tool.

15. An advertising tool according to claim 11, wherein said plurality of plates includes a second plate having a slide panel received therein, said second plate having a window for viewing images on said slide panel.

16. An advertising tool according to claim 15, wherein said window contains a transparent model of a shadow mask, said second plate having a second window adjacent the first-mentioned window, said second window having a transparent model of an aperture grill mounted therein, and said panel having two images spaced apart the distance of said windows.

* * * * *